US008365827B2

(12) United States Patent
O'Connell et al.

(10) Patent No.: US 8,365,827 B2
(45) Date of Patent: Feb. 5, 2013

(54) FRACTURING METHOD TO REDUCE TORTUOSITY

(75) Inventors: Maria M. O'Connell, Cypress, TX (US); Michael H. Johnson, Katy, TX (US); David A. Castillo, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 303 days.

(21) Appl. No.: 12/816,824

(22) Filed: Jun. 16, 2010

(65) Prior Publication Data

US 2011/0308803 A1 Dec. 22, 2011

(51) Int. Cl.
*E21B 43/26* (2006.01)

(52) U.S. Cl. ..... 166/308.1; 166/222; 166/381; 175/293; 173/90

(58) Field of Classification Search ..... 166/308.1, 166/381, 259, 271, 222, 223, 100; 175/267, 175/293; 173/90
See application file for complete search history.

(56) References Cited

U.S. PATENT DOCUMENTS 3,130,786 A 4/1964 Brown et al.
3,245,472 A * 4/1966 Zandmer ..... 166/100
3,326,291 A * 6/1967 Zandmer ..... 166/100
3,347,317 A * 10/1967 Zandmer ..... 166/100
3,390,724 A * 7/1968 Caldwell ..... 166/100
3,391,737 A 7/1968 Havens
4,050,529 A 9/1977 Tagirov et al.
4,103,971 A 8/1978 Denisart et al.
4,285,398 A * 8/1981 Zandmer et al. ..... 166/100
4,479,541 A 10/1984 Wang
4,529,036 A 7/1985 Daneshy et al.
4,808,925 A 2/1989 Baird
4,880,059 A 11/1989 Brandell et al.
4,919,204 A 4/1990 Baker et al.
4,951,751 A 8/1990 Jennings, Jr.
4,974,675 A 12/1990 Austin et al.
5,111,881 A 5/1992 Soliman et al.
5,117,912 A 6/1992 Young
5,249,628 A 10/1993 Surjaatmadja
5,325,923 A 7/1994 Surjaatmadja et al.
5,335,724 A 8/1994 Venditto et al.
5,363,919 A 11/1994 Jennings, Jr.
5,363,927 A 11/1994 Frank
5,381,864 A 1/1995 Nguyen et al.
5,396,957 A 3/1995 Surjaatmadja et al.
5,406,078 A 4/1995 Jacobson
5,425,424 A 6/1995 Reinhardt et al.
5,445,220 A 8/1995 Gurevich
5,484,016 A 1/1996 Surjaatmadja et al.
5,494,103 A 2/1996 Surjaatmadja et al.
5,499,678 A 3/1996 Surjaatmadja et al.
(Continued)

*Primary Examiner* — Daniel P Stephenson
(74) *Attorney, Agent, or Firm* — Steve Rosenblatt

(57) ABSTRACT

A series of jet nozzles have a telescoping structure designed to impact the borehole wall and initiate a fracture. The nozzles can be extended through fluid pumped through them or with some mechanical force from within the bottom hole assembly. The leading ends of the telescoping assembly can be sharp and hardened to facilitate the initiation of a formation fracture in an open hole. The telescoping structures can be disposed in a single or multiple rows with the circumferential spacing being such that each telescoping structure is designed to cover a target circumferential distance of 45 degrees or less so that jetted fluid from at least one jet will be within 22.5 degrees of a location of maximum formation stresses to reduce the tortuosity of the created fractures from jetting through the nozzles with possible enhancement of the fracturing from added annulus pressure.

18 Claims, 1 Drawing Sheet

U.S. PATENT DOCUMENTS 5,533,571 A 7/1996 Surjaatmadja et al.
5,743,334 A 4/1998 Nelson
5,765,642 A 6/1998 Surjaatmadja
5,894,888 A 4/1999 Wiemers et al.
5,899,958 A 5/1999 Dowell et al.
5,941,308 A 8/1999 Malone et al.
6,006,838 A 12/1999 Whiteley et al.
6,012,525 A 1/2000 Burleson et al.
6,116,343 A 9/2000 van Petegem et al.
6,230,805 B1 5/2001 Vercaemer et al.
6,257,338 B1 7/2001 Kilgore
6,286,598 B1 9/2001 van Petegem et al.
6,286,600 B1 9/2001 Hall et al.
6,306,800 B1 10/2001 Samuel et al.
6,394,184 B2 5/2002 Tolman et al.
6,662,874 B2 12/2003 Surjaatmadja et al.
6,719,054 B2 4/2004 Cheng et al.
6,725,933 B2 4/2004 Middaugh et al.
6,779,607 B2 8/2004 Middaugh et al.
6,938,690 B2 9/2005 Surjaatmadja
7,017,665 B2 3/2006 Nguyen
7,159,660 B2 1/2007 Justus
7,225,869 B2 6/2007 Willett et al.
7,237,612 B2 7/2007 Surjaatmadja et al.
7,278,486 B2 10/2007 Alba et al.
7,287,592 B2 10/2007 Surjaatmadja et al.
7,337,844 B2 3/2008 Surjaatmadja et al.
7,343,974 B2 3/2008 Cowan
7,401,648 B2 7/2008 Richard
7,422,058 B2 * 9/2008 O'Malley ..... 166/187
7,431,090 B2 * 10/2008 Surjaatmadja et al. .... 166/308.1
7,475,729 B2 * 1/2009 Johnson ..... 166/305.1
7,604,055 B2 10/2009 Richard
7,681,635 B2 3/2010 Farabee et al.
7,798,213 B2 * 9/2010 Harvey et al. ..... 166/242.7
8,079,416 B2 * 12/2011 Parker ..... 166/285
8,127,858 B2 * 3/2012 Lynde et al. ..... 166/383
8,151,886 B2 * 4/2012 Xu et al. ..... 166/308.1
2008/0083531 A1 4/2008 Surjaatmadja
2009/0107680 A1 4/2009 Surjaatmadja
2009/0173497 A1 * 7/2009 Dusterhoft ..... 166/276
2009/0283260 A1 11/2009 Surjaatmadja et al.
2009/0321076 A1 * 12/2009 Wiley et al. ..... 166/308.1
2011/0220361 A1 * 9/2011 Huang ..... 166/308.1
2012/0118573 A1 * 5/2012 Richard et al. ..... 166/308.1

* cited by examiner

FRACTURING METHOD TO REDUCE TORTUOSITY

FIELD OF THE INVENTION

The field of the invention is jet fracturing in open hole and more particularly initiation of fractures with extending members while propagating the initiated fractures with pressurized fluid delivered into the open hole fractures through a jet tool or/and into the surrounding annulus.

BACKGROUND OF THE INVENTION

Fracturing in open hole is a complex subject and has been studied and written about by various authors. Whether using explosives or fluid jets one of the problems with the initiated fractures is in the way they propagate. If the propagation pattern is more tortuous as the fractures emanate from the borehole an undesirable condition called screenout can occur that can dramatically decrease the well productivity after it is put on production.

Hydraulically fracturing from any borehole in any well orientation is complex because of the earth's ambient stress field operating in the area. This is complicated further because of the extreme stress concentrations that can occur along the borehole at various positions around the well. For instance, there are positions around the borehole that may be easier to create a tensile crack than other positions where extreme compressive pressures are preventing tensile failure. One way that has been suggested to minimize this condition is to use jets that create a series of fan shaped slots in the formation with the thinking that a series of coplanar cavities in the formation will result in decreased tortuosity. This concept is discussed in SPE 28761 Surjatmaadja, Abass and Brumley Elimination of Near-wellbore Tortuosities by Means of Hydrojetting (1994). Other references discus creating slots in the formation such as U.S. Pat. Nos. 7,017,665; 5,335,724; 5,494,103; 5,484,016 and US Publication 2009/0107680.

Other approaches oriented the jet nozzles at oblique angles to the wellbore to try to affect the way the fractures propagated. Some examples of such approaches are U.S. Pat. Nos. 7,159,660; 5,111,881; 6,938,690; 5,533,571; 5,499,678 and US Publications 2008/0083531 and 2009/0283260.

Other approaches involved some form of annulus pumping in conjunction with jet fracturing. Some examples of this technique are U.S. Pat. Nos. 7,278,486; 7,681,635; 7,343,974; 7,337,844; 7,237,612; 7,225,869; 6,779,607; 6,725,933; 6,719,054 and 6,662,874.

Jets mounted to telescoping assemblies have been suggested with the idea being that if the jet is brought closer to the formation the fracturing performance will improve. This was discussed in U.S. application Ser. No. 12/618,032 filed Nov. 13, 2009 called Open Hole Stimulation with Jet Tool and is commonly assigned to Baker Hughes Inc. In another variation of telescoping members used for fracturing the idea was to extend the telescoping members to the borehole wall and to set spaced packers in the annulus so as to avoid the need to cement and to allow production from the telescoping members after using some of them to initially fracture the formation. This was discussed in U.S. application Ser. No. 12/463,944 filed May 11, 2009 and entitled Fracturing with Telescoping Members and Sealing the Annular Space and is also commonly assigned.

The present invention uses telescoping members and drives them out against the borehole wall with sufficient force to mechanically initiate the fracture. The telescoping members can be driven out by flowing through them or displacing them forcefully from within a bottom hole assembly using mechanical force such as a wedge device or a swage that also affords the option of expanding the diameter of the tubular housing in which the telescoping members are located. The telescoping members can have a constriction in them to function as the jet or simply a through passage that will act as a fluid jet when sufficient fluid volume with enough differential pressure is delivered through the jet nozzles. In another embodiment the positioning of the jets around a housing so that there is at least one nozzle within 22.5° in either of two opposed directions from the location of where the circumferential stresses are expected to the least compressive stress concentration which is the same as the most tensile stress concentration so that the fractures formed are less tortuous and subsequent production is enhanced. The jets can be disposed in a single or multiple rows depending on the telescoping member size and the borehole diameter. By getting at least one nozzle close to the more stressed location in the formation at the borehole the fracture initiated and propagated will be less tortuous. These and other benefits of the present invention will be more readily understood by those skilled in the art from a review of the description of the preferred embodiment and the associated drawings while recognizing that the full scope of the invention is determined by the appended claims.

SUMMARY OF THE INVENTION

A series of jet nozzles have a telescoping structure designed to impact the borehole wall and initiate a fracture. The nozzles can be extended through fluid pumped through them or with some mechanical force from within the bottom hole assembly. The leading ends of the telescoping assembly can be sharp and hardened to facilitate the initiation of a formation fracture in an open hole. The telescoping structures can be disposed in a single or multiple rows with the circumferential spacing being such that each telescoping structure is designed to cover a target circumferential distance of 45 degrees or less so that jetted fluid from at least one jet will be within 22.5 degrees of a location of maximum formation stresses to reduce the tortuosity of the created fractures from jetting through the nozzles with possible enhancement of the fracturing from added annulus pressure.

DETAILED DESCRIPTION OF THE PREFERRED EMBODIMENT

Figure 1:
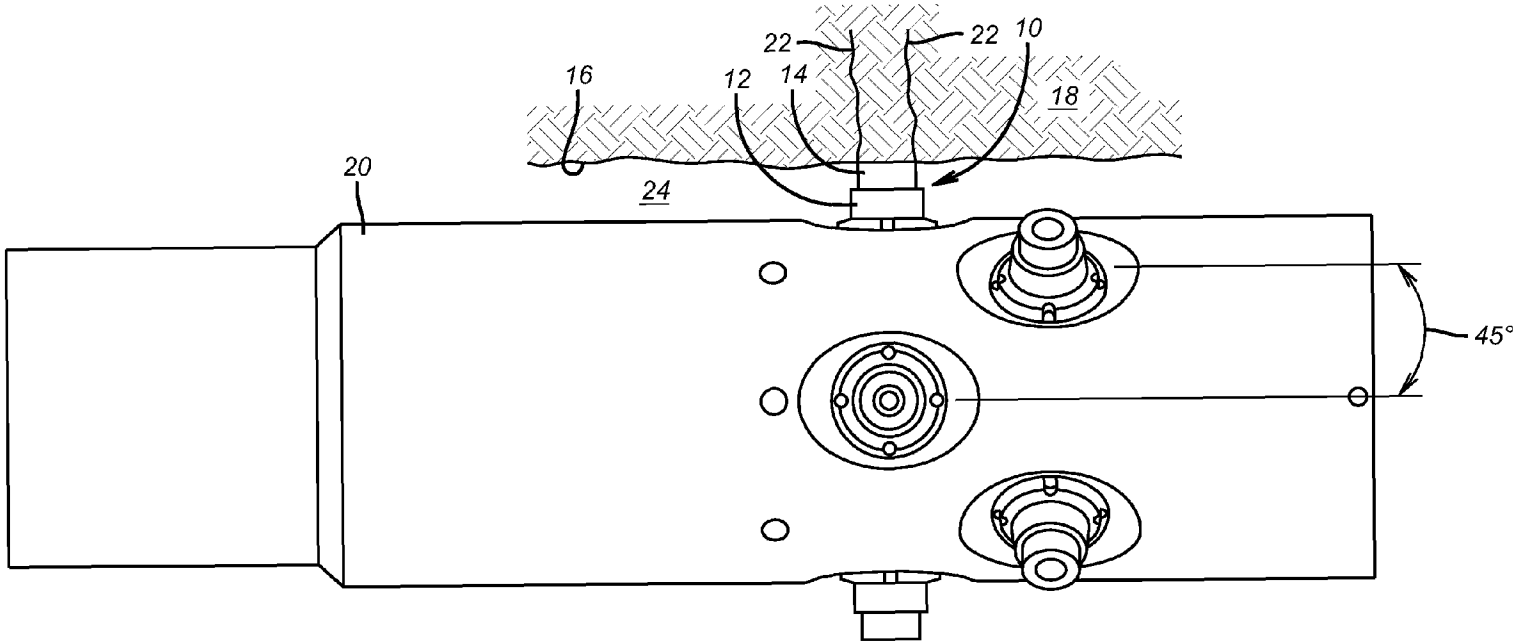
FIG. 1 illustrates an array of extendable jet nozzles that are driven out against the open hole wellbore to initiate fractures as well as showing an alternative embodiment of spacing the nozzles in a manner that reduces tortuosity.
Figure 2:
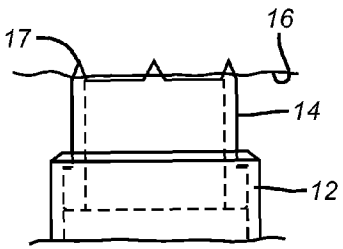
FIG. 2 is a detail of how a telescoping nozzle strikes the borehole wall to create a fracture that is then propagated with fluid through the jet or/and delivered into the annulus.

In one embodiment a jet nozzle 10 that can be one of many is made of several telescoping components such as 12 and 14 that are nested. There can be more than two nested components depending on the degree of extension needed to engage the wellbore wall 16. The preferred application is in open hole. The innermost nested component that will extend the furthest and forcibly strike the wellbore wall 16 is designed to initiate fractures from impact. It can have one or more sharp points 17 at the leading end to break and penetrate into the formation. The leading end can also be hardened to prevent the sharp points on the leading end from breaking off when driven into the formation 18. The telescoping elements 12 and 14 define a passage that serves as the jet or alternatively there can be an orifice or other constriction to create not only a jet force to fracture the formation further but it can also initially accelerate members 12 and 14 toward the wellbore wall 16 to start the fractures. The telescoping members 12 and 14 can be ratcheted together to allow them to extend radially to hit the wellbore wall 16 and to hold them extended and prevent collapse back into the housing 20. The pressure drop through the jet nozzle assembly causes the telescoping parts such as 12 and 14 to move against the borehole wall 16 with great force to initiate a fracture. Alternatively the jets 10 can be initially obstructed so that pressure delivered behind them drives the telescoping members 12 and 14 out and the plugs can then be blown out or dissolved or removed by any other means. It should be noted that extension of the telescoping members is for the purpose of impact against the wellbore wall 16 and that sealing against the wellbore wall is not required. It is the wall impact that is intended to initiate the fracture using the sharp leading end at 17. Alternatively the leading end can be hardened but blunt and the wall impact used to initiate the fracture at the wellbore wall 16. Subsequently flow commences and enters the fracture initiated by the sharp points 17 so that the fracture opens further and propagates away from the borehole. Continued pressure application with some flow as the fractures enlarge coming through the telescoping components 12 and 14 has the effect of extending the fractures further away from the borehole and holding them open as an optional proppant is delivered to hold the fractures open even when the pressure through the jets is backed off. As another option the telescoping members can have screens in them and can be subsequently used to produce the formation 18.

The fractures 22 after being initiated with the telescoping components 12 and 14 can be extended by pressure delivered through the housing 20 or around the outside of it in an annulus 24 from the surface.

In another embodiment the location of the jets 10 on the body 20 enhances the quality of the fractures created by reducing tortuosity. The jets can be of the telescoping design as shown in FIG. 1 or they can be fixed. The pattern the jets take on the body 20 accounts for the enhanced fracture quality by positioning the jets 10 so that there is a jet no further circumferentially than 22.5 degrees from a zone where the least compressive stress concentration exists. For example, depending on the stress field operative in a particular region, a nearly horizontal open hole wellbore may find that the zones of the least compressive stress concentration are likely located closer to the 12 o'clock and 6 o'clock locations. Other stress regimes or other well trajectories may find these zones of the least compressive stress concentration located at other positions along the borehole, such as 9 o'clock and 3 o'clock, or a direction oblique to the top-bottom-sides of the borehole. By using jets that are no more than 45 degrees apart circumferentially whether in one plane or in several rows as shown in FIG. 1, the result is that no single jet is more than 22.5 degrees from its center to alignment with the zone of the least compressive stress concentration. Where the size of the housing 20 and the surrounding borehole wall 16 permits, denser packing using even closer spacing can be obtained. Factors that play into the distribution are the diameter of each jet and the pressure rating of the housing 20 which is affected by the number of openings in it to place nozzles. If rows are used as in FIG. 1 then staggering jets in adjacent rows allows the jets to be closer together. When the jets are oriented closer to alignment with the zones of least compressive stress concentration in the formation the hydraulic fractures formed, particularly more than a distance of the wellbore diameter from the borehole wall tend to be wider and deeper and less tortuous. Other less optimal orientations that direct the jets more toward the greatest compressive stress concentration zones in the formation will promote additional tortuosity as the fracture will deviate when getting about the length of the wellbore diameter into the formation and propagate in a perpendicular direction to the direction of the initiated fracture. The fracture is then more likely to be tortuous and running along a horizontal borehole or transverse to the borehole and in a parallel plane to the axis of the borehole. The zones of lower stress are identified by simulations and mathematical modeling of how drilling a borehole in a formation of a known stress-field affects the stress distribution around it. Using that information the spacing of the jets so that at least one jet is no more than 22.5 degrees from true alignment of a low stress zone achieves the optimum fractures with minimal tortuosity.

The features of the telescoping jets that initiate the fractures by penetrating the formation as described above can also be used in tandem with the spacing of the jets to obtain less tortuosity as also described above.

Those skilled in the art will appreciate that the present invention initiates fractures mechanically in a jet fracturing environment so that the initiated fractures are further propagated by fluid pressure delivered through the jets and/or the annulus surrounding the jet housing. Apart from the unique way of initiating the fractures the present invention associates jet placement with the zones of the least compressive stress concentration in the formation that are located a distance of at least a diameter of the wellbore into the formation. By disposing at least one jet no further than 22.5 degrees from the least compressive stress concentration, the resulting tortuosity is greatly reduced. Spacing the jets 10 in single or multiple rows in a nested arrangement where the circumferential distance between adjacent jets is about 45 degrees achieves this result. In more general terms the present invention recognizes the relation between the orientation of the jets toward a lower compressive stress concentration zone to reduce fracture tortuosity, depending on the deviation of the borehole for a given stress environment.

The above description is illustrative of the preferred embodiment and many modifications may be made by those skilled in the art without departing from the invention whose scope is to be determined from the literal and equivalent scope of the claims below.

We claim:

1. A method of fracturing a formation at a subterranean location comprising:

locating at least one telescoping jet on a housing;

delivering the housing to the subterranean location;

extending the telescoping jet to impact the formation;

creating a fracture with said impact;

propagating said fracture with pressure delivered to said fracture; and removing said housing.

2. The method of claim 1, comprising:

providing relatively movable components having an opening through them as said jet.

3. The method of claim 2, comprising:

providing at least one sharp leading edge on the movable component that engages the formation.

4. The method of claim 2, comprising:

providing a hardened leading edge on the movable component that engages the formation than other portions of said movable components.

5. The method of claim 2, comprising:

retaining said components in an extended condition against radial retraction away from contact with the formation.

6. The method of claim 2, comprising:

providing a restriction in said opening to function as said jet.

7. The method of claim 2, comprising:

extending said components with flow or pressure in said opening.

8. The method of claim 2, comprising:

providing a plurality of jets as said at least one jet;

circumferentially spacing adjacent jets in one or more rows so that said spacing does not exceed 45 degrees in a plane perpendicular to an axis of said housing.

9. The method of claim 8, comprising providing said jets in multiple rows and offsetting the jets in adjacent rows.

10. The method of claim 2, comprising:

providing a plurality of jets as said at least one jet;

disposing said jets in an array that reduces tortuosity of the created fractures by aiming at least one jet toward a lower stress location in the formation at the subterranean location.

11. The method of claim 2, comprising:

providing a plurality of jets as said at least one jet;

disposing said jets in an array that puts at least one jet within 22.5 degrees circumferentially of a lower stress location in the formation at the subterranean location.

12. The method of claim 10, comprising:

providing a screen in at least one jet;

producing the formation through said jet with said screen after initiating a fracture with said jet.

13. A method of fracturing a formation at an open hole subterranean location comprising:

locating a plurality of jets on a housing;

delivering the housing to the open hole subterranean location;

disposing said jets in an array that reduces tortuosity of the created fractures by aiming at least one jet toward a lower stress location in the formation at the subterranean location;

providing a telescoping feature for said jets extending said telescoping jets to impact the formation;

initiating a fracture with said impact;

propagating said fracture hydraulically with pressure delivered to said fracture.

14. The method of claim 13, comprising:

disposing said jets in an array that puts at least one jet within 22.5 degrees circumferentially of a lower stress location in the formation at the subterranean location.

15. The method of claim 14, comprising:

circumferentially spacing adjacent jets in one or more rows so that said spacing does not exceed 45 degrees in a plane perpendicular to an axis of said housing.

16. The method of claim 13, comprising:

providing relatively movable components having an opening through them as said jet.

17. The method of claim 16, comprising:

providing at least one sharp leading edge on the movable component that engages the formation.

18. The method of claim 16, comprising:

providing a hardened leading edge on the movable component that engages the formation than other portions of said movable components.

* * * * *